US005997353A

United States Patent [19]

Guiol

[11] Patent Number: 5,997,353

[45] Date of Patent: Dec. 7, 1999

[54] METALLIC CONNECTOR HOUSING

[76] Inventor: Eric Guiol, Grüne Gärtel 15, 76316 Malsch, Germany

[21] Appl. No.: 08/932,549

[22] Filed: Sep. 17, 1997

Related U.S. Application Data

[60] Continuation of application No. 08/674,000, Jul. 1, 1996, Pat. No. 5,718,608, which is a division of application No. 08/526,615, Sep. 11, 1995, abandoned, which is a division of application No. 08/257,996, Jun. 10, 1994, Pat. No. 5,536,185, which is a continuation of application No. 08/008,067, Dec. 24, 1992, abandoned, which is a continuation of application No. 07/692,765, Apr. 29, 1991, abandoned.

[30] Foreign Application Priority Data

Apr. 30, 1990 [DE] Germany ..... 40 13 963

[51] Int. Cl.[6] ..... H01R 9/03

[52] U.S. Cl. ..... 439/610; 439/98

[58] Field of Search ..... 439/607, 610, 439/92, 95, 96, 108, 101, 98

[56] References Cited

U.S. PATENT DOCUMENTS

| | | | |
|---|---|---|---|
| 1,282,468 | 10/1918 | Scheel | 439/445 |
| 2,678,963 | 5/1954 | Everhart | 439/98 |
| 2,710,381 | 6/1955 | Monson | 439/95 |
| 2,816,949 | 12/1957 | Curtiss | 439/48 |
| 2,836,647 | 5/1958 | Strauss et al. | 439/459 |
| 3,027,533 | 3/1962 | Monson | 439/95 |
| 3,082,291 | 3/1963 | Parkinson et al. | 174/77 |
| 3,783,321 | 1/1974 | Patterson | 174/152 |
| 3,876,277 | 4/1975 | Colwell | 439/551 |
| 4,737,601 | 4/1988 | Gartzke | 174/152 |
| 4,744,774 | 5/1988 | Pauza | 439/225 |
| 4,855,533 | 8/1989 | Meyer Swantee | 439/95 |
| 4,886,464 | 12/1989 | Zetena, Jr. | 439/98 |
| 4,896,939 | 1/1990 | O'Brien | 350/96.23 |
| 5,012,042 | 4/1991 | Summach | 174/35 |
| 5,059,139 | 10/1991 | Spinner | 439/583 |

FOREIGN PATENT DOCUMENTS

| | | |
|---|---|---|
| 1 138 066 | 12/1982 | Canada . |
| 1690156 | 9/1971 | Germany . |
| 83 29 128 | 11/1983 | Germany . |
| 3439931 | 5/1986 | Germany . |
| 8707004 | 8/1987 | Germany . |
| 2 060 278 | 4/1981 | United Kingdom . |

OTHER PUBLICATIONS

Military Specification Sheet, MIL–C–85049/10A, Nov. 30, 1990, "Connector Accessories, Electrical, Backshell, Environmental, Cable Sealing, Straight, Shield Termination, Category1A" p. 1.

Drawings, Glenair, Inc., #712–039 (Sep. 12,1985); #712–046 (Nov. 7,1985); and 470–002 (Aug. 24,1987).

Drawings, Glenair, Inc., #380–X·S40 (Jun. 22, 1987) and #380·X·S068 (Nov. 2, 1988).

Catalogue, SOCAPEX, "Connector", 1982.

*Primary Examiner*—Hein Vu

*Attorney, Agent, or Firm*—Gary A. Samuels

[57] ABSTRACT

A metallic housing for a shielded electrical connector is provided for connection to a tube-like electrical shield of an electrical cable which is to be connected to the connector. The metallic housing has an opening formed in a face wall at a side where the electrical cable is inserted therethrough. A sleeve, having an inlet opening, is provided with a flange contacting one side of the face wall. The sleeve has at least one projection with an outer thread protruding from the other side of the face wall, onto which a threaded nut is screwed in order to clamp the face wall between the flange and the threaded nut. An end area of the sleeve adjacent to the side at which the cable is inserted has a larger inner diameter adapted to the outer diameter of the cable and the remaining part of the sleeve has a smaller inner diameter adapted to the outer diameter of the shield thereby providing an electromagnetically tight connection.

2 Claims, 2 Drawing Sheets

METALLIC CONNECTOR HOUSING

This is a continuation application of Ser. No. 08/674,000, filed Jul. 1, 1996, which is a division of application Ser. No. 08/526,615, filed Sep. 11, 1995, which is a division of Ser. No. 08/257,996, filed Jun. 10, 1994; which is a continuation of application Ser. No. 08/008,067, filed Dec. 24, 1992 (abandoned); which is a continuation of application Ser. No. 07/692,765 filed Apr. 29, 1991 (abandoned).

FIELD OF THE INVENTION

The invention relates to a metallic connector housing for a shielded electrical connector.

BACKGROUND OF THE INVENTION

Electrical cables for signal transmission are mostly provided with a tube-shaped shield surrounding the signal conductors of the cable. The shield consists of an electrically conductive material in order to prevent electromagnetic interference fields from affecting the signal conductors and to suppress electromagnetic radiation from the cable, which might disturb adjacent cables or units. Such shields primarily consist of a metal braiding surrounding an insulating sheath which covers the signal conductor. The braiding is covered by an insulating outer jacket of the cable.

Cables of this type are frequently terminated by connectors, in particular plug connectors in order to connect the signal conductor with other cables or units. In order to avoid electromagnetic interference in the area of these connectors, the latter are usually surrounded by a metal housing which is electrically connected to the cable shield. Frequently, backshells are provided. These are connected with the cable shield on a side at which the cable is inserted and which are attached to the metal housing of the connector at the opposite side, for example, by screw connections. The function of these backshells is twofold: first, they serve as a strain relief for the cable; second, they are used to transmit the electrical potential of the cable shield to the potential of the metal housing.

For this reason, known backshells are provided with a sleeve part surrounded by a shield, whereas the remaining part of the cable is guided through the sleeve into the backshell. In order to apply the shield to the outer circumference of the sleeve part, the shield braiding has to be opened so that it fits into the sleeve part. The area of the opened shield which had been slipped over the sleeve part is then crimped onto the sleeve part, where it is attached by means of a tape or a clamp, or it is shrunk under a magnetic field. In the latter case, the connection is irreversible and does not allow for any repairs.

When the braiding of the shield is opened for slipping it over the sleeve, the shield becomes electromagnetically permeable, so that the entire system containing said connector will become susceptible to electromagnetic interference.

A device for screwing a coaxial cable end to an amplifier housing is known from DE 83 29 128 U1, wherein the shield is only indirectly connected to the sleeve by a contact cage. The contact cage is located in a radial gap between the shield and an enlarged inner diameter of the sleeve. One axial end of the contact cage reaches up to the corresponding axial end of the sleeve.

In that region of frequencies in which high-frequency cables are mainly utilized, namely those beginning at approximately 1 MHz, a contact cage behaves like a slot antenna. This means, it emits high-frequency radiation and absorbs incoming high-frequency radiation. For this reason, the end area of the cable jacket covering the shield which is located adjacent to the sleeve and the contact cage cannot prevent interference by emitted or absorbed radiation. In order to assure a sufficient electrical contact between the sleeve and the shield, taking into account expected production tolerances, the contact cage must have a relatively strong spring force. In case of cables of particularly good high-frequency characteristics, the dielectric between the shield and the inner conductor often consists of a relatively soft material, such as expanded microporous polytetrafluoroethylene (PTFE). This soft material is radially compressed towards the inside by the spring force of the contact cage. As a consequence, the cable construction is deformed at the place where the contact cage is located. This in turn causes an undesirable change of the characteristic wave resistance of the cable at the contact cage. This change in wave resistance impairs the transmission quality of the high-frequency signals to be transmitted by the cable.

There is a need for a connection in which the cable shield can be connected to a connector without detracting from the electromagnetic shield effect and the electrical characteristics of the cable.

SUMMARY OF THE INVENTION

A metallic housing for a shielded electrical connector is provided for connection to a tube-like electrical shield of an electrical cable which is to be connected to the connector. The metallic housing has an opening formed in a face wall at a side where the electrical cable is inserted therethrough. A sleeve, having an inlet opening, is provided with a flange contacting one side of the face wall. The sleeve has at least one projection with an outer thread protruding from the other side of the face wall, onto which a threaded nut is screwed in order to clamp the face wall between the flange and the threaded nut. An end area of the sleeve adjacent to the side at which the cable is inserted has a larger inner diameter adapted to the outer diameter of the cable and the remaining part of the sleeve has a smaller inner diameter adapted to the outer diameter of the shield thereby providing an electromagnetically tight connection.

A holding tool may be applied to the sleeve, the tool being formed by two flattened areas of symmetrical axes so that an open-jawed wrench can be applied.

A sheath may also be provided to protect the cable from kinks, that is either molded or adhesively bonded to the threaded nut. The threaded nut may be provided with a sleeve-shaped appendix having at least one radially projecting anchor at the outer circumference of the appendix.

The housing may be constructed of a metallic backshell. One embodiment includes the electrical connector having the sleeve slipped over an end area of the shield which had been stripped of the outer insulating jacket and is soldered to the shield. A part of the shield may also be folded back over the sleeve into the housing where the shield is attached by means of a crimp sleeve.

DETAILED DESCRIPTION OF THE INVENTION

A connector is provided having a housing to be used with a cable shield that does not need to be opened. The sleeve of the housing may be slipped over the unopened shield. Subsequently, the shield and the sleeve are electrically and mechanically connected with each other, preferably by soldering or crimping of a part of the shield which has been folded back onto the outer circumference of the sleeve. The sleeve is then screwed to the metallic housing. Due to this connection method, the shield keeps its unchanged form, also within the sleeve. The sleeve itself, and subsequently the housing, assume the function of the electromagnetic shield. This connection method makes the shield resistant to electromagnetic interference.

The outer part of the sleeve which projects from the sleeve and is provided with the outer thread is preferably flattened out on two opposite sides. This facilitates a screw connection between the sleeve and the housing. Due to the flattened areas the sleeve can be held stationary with an open-jawed wrench while the threaded nut is tightened. The opening of the housing is preferably adapted to these flattened outer contours of the outer part of the sleeve.

The sleeve may have a graduated inner diameter in order to take up not only the end area of the shield from which the outer jacket had been removed, but also an end area of the outer insulating jacket. This affords a particular protection of the transitional area between the outer insulating jacket and the free shield.

Figure 1:
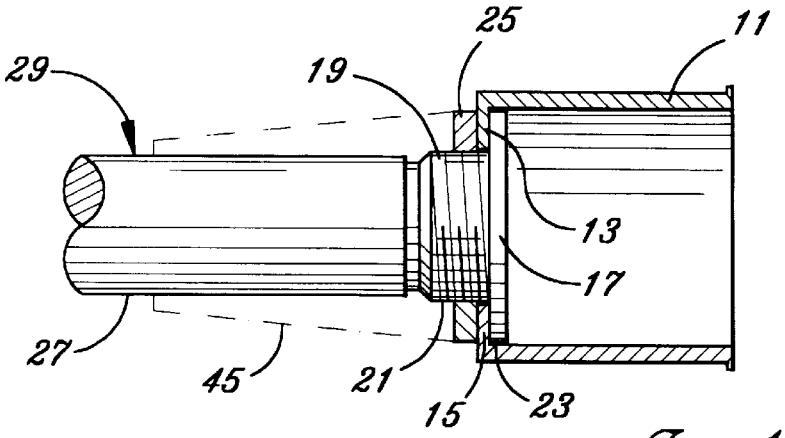
FIG. 1 is a schematic lateral view of a metallic housing connected to a shielded cable.

A sheath 45 (as shown in FIG. 1) protects the cable from kinks, and is slipped over the interface area between sleeve and cable. The sheath and the nut are preferably one piece in design, in the form of a plastic sheath injection-molded to the nut, and cover part of the cable area adjacent to the sleeve in conically tapering diameter. The sheath 45 may also be injection molded to the cable after assembly of the connector, preferably using the same material as the outer insulating jacket of the cable. A threaded nut with a sleeve-shaped appendix is used in this embodiment. On the appendix there is at least one anchor for accommodating the material of the sheath 45. After tightening the threaded nut, the sheath 45 is injection-molded around the appendix, at least at an area comprising the anchor, and around the outer insulating jacket. This results in an additional strain relief for the cable.

Figure 1A:
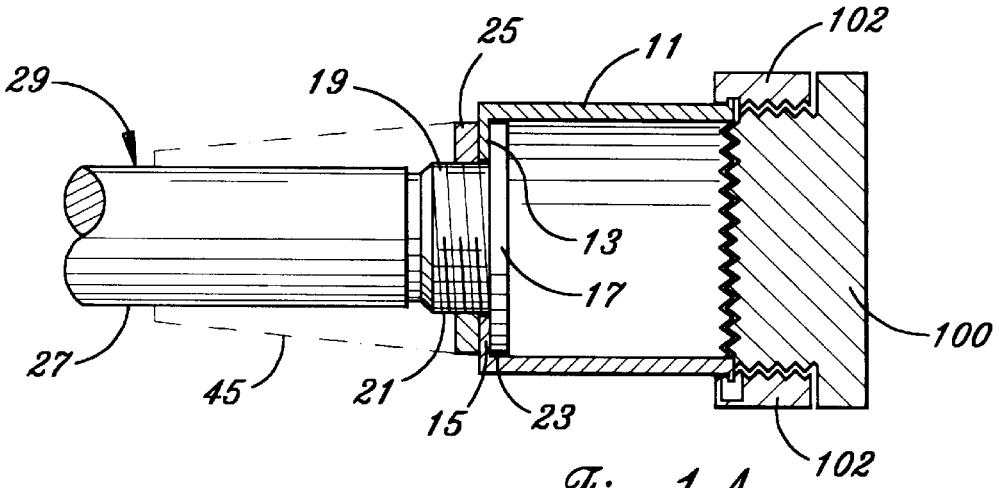
FIG. 1*a* is a schematic lateral view of a metallic housing connected to a shielded cable showing the housing as a metallic backshell attached to a connector housing 100.

The metallic housing may be a backshell as shown in FIG. 1*a* which is screwed 102 to the metallic housing 100 of a shielded connector itself. An essential feature of the solution provided by the invention is that the screw connection between the sleeve and the metallic housing may be opened at any time, thus allowing for repairs at the connector and/or contact pins of the connector.

The solution provided by the invention is also suitable for so-called EMI-tubes (i.e. electromagnetic interference tubes) or shielded cables without any contents through which cable conductors or leads may be inserted at a later date.

The invention is understood with reference to the accompanying drawings.

FIG. 1 shows the application of the invention in a metallic backshell which may be screwed to the metallic housing of a connector.

FIG. 1 also shows a metallic housing 11 with a face wall 13 at the side at which the cable is inserted. This face wall 13 incorporates an opening 15 with an inlet sleeve 17 provided with an outer part 19 which protrudes from the housing 11 and is equipped with an outer thread 21 and a radial flange 23 contacting the inner side of the face wall 13. A threaded nut 25 is screwed to the outer thread 21. This threaded nut 25 serves to link the lateral wall 13 and the flange 23. An outer insulating jacket 27 of an electrical cable 29 is located adjacent to the end of the sleeve 17 protruding from the housing 11.

Figure 2:
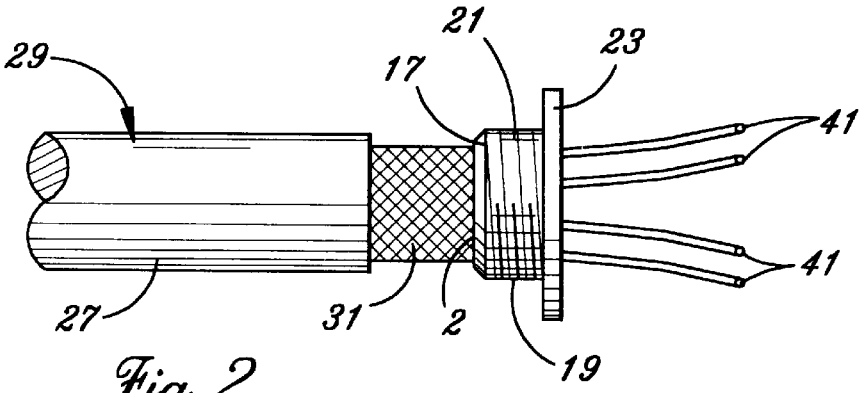
FIG. 2 is a part of the connector arrangement shown in FIG. 1, according to one embodiment of the invention.

As shown most clearly in FIG. 2, the cable 29 is equipped with a braided shield 31. A piece of the outer insulating jacket 27 is stripped from the cable end, so that the shield 31 is free. The sleeve 17 is slipped over the part of the shield 31 which was laid open. The sleeve is provided with a through-opening 33 (FIG. 4) which is adapted to the outer diameter of the shield 31 so that the sleeve 17 can be slipped on the shield 31 in an exact fit.

FIG. 2 also shows an embodiment wherein the sleeve 17 is soldered to the shield 31 at location 2 after having been slipped over the latter. The length of the part of the shield 31 which is laid open is preferably dimensioned such that the free end of the shield 31 essentially flushes with the side of the sleeve 17 facing the flange when the sleeve 17 is completely slipped over the shield. In this case, the flange 23 forms the axial end of the sleeve 17 which faces away from the outer insulating jacket 27.

Figure 3:
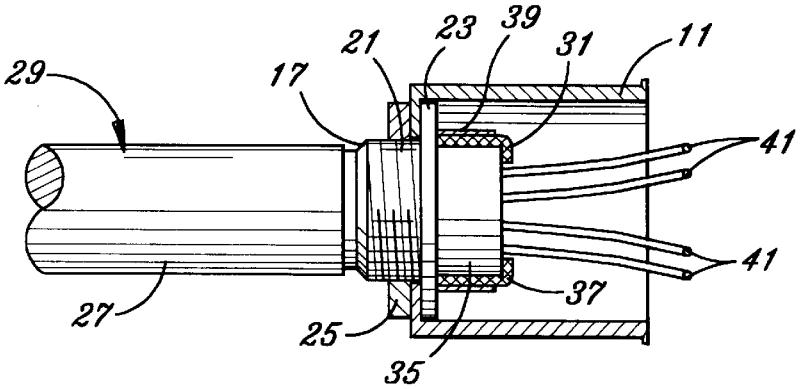
FIG. 3 is a part of the connector arrangement shown in FIG. 1 according to an alternate embodiment of the invention.

FIG. 3 shows an embodiment wherein the sleeve 17 is provided with a sleeve appendix 35 on the side of the flange 23 facing away from the outer thread 21. In this embodiment of the sleeve 17, the outer insulating jacket 27 is removed from the shield 31 to a length in which the free end of the shield 31 can be folded back around the sleeve appendix 35 after the sleeve has been completely slipped over the shield. A crimping sleeve 39 is mounted to the folded back part 37 of the shield 31. By means of sleeve 39, the turned over part can be clamped to the sleeve appendix 35.

FIGS. 2 and 3 show insulated signal conductors 41 which project from the axial end of the sleeve facing the side of the flange and sleeve appendix and which can be connected to the contacts of a connector (not shown in the figures).

Figure 4:
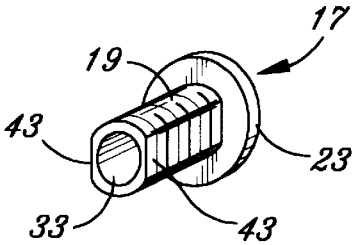
FIG. 4 is an example of a sleeve of the connector arrangement shown in FIG. 1.

FIG. 4 is a perspective drawing of a particularly preferred embodiment of a sleeve 17. The outer thread 21 is not shown. This sleeve is provided with two flattened pieces 43 facing each other which may be handled by a open-jawed wrench. The sleeve 17 may thus be held stationary while the threaded nut 25 is tightened.

Figure 5:
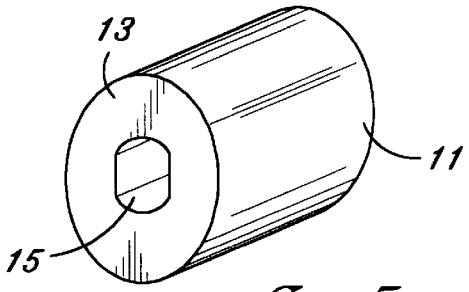
FIG. 5 is a metallic housing adapted to the sleeve shown in FIG. 4.

FIG. 5 shows a housing 11 having opening adapted to the shape of the sleeve shown in FIG. 4.

Figure 6:
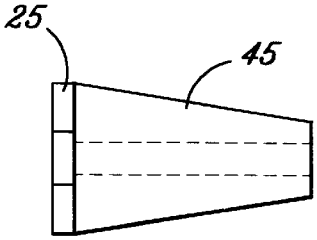
FIG. 6 is a sheath protecting the cable from kinks suitable for the connector arrangement shown in FIG. 1.

FIG. 6 shows a plastic sheath 45 which protects the cable from kinking. This sleeve 45 is injection-molded or adhesively bonded to the threaded nut 25. FIG. 1 also shows the sheath 45 as a dotted line.

The connector arrangement provided by the invention is produced in that at first the sheath 45, the threaded nut 25, or both as a unit, and subsequently the housing 11, are slipped over the free end of the cable 29 until the cable end is accessible and in order to remove the jacket from the cable and trim the shield 31. After laying open and trimming the shield 31, the sleeve 17 is slipped over the free part of the shield 31 and connected to the latter by soldering or by means of the crimping sleeve 39 (FIG. 3). Subsequently, the housing 11 is pushed toward the cable until the face wall 13 contacts the flange 23. Then the threaded nut 25 is screwed to the outer thread 21 in order to clamp the face wall 13 between the flange 23 and the threaded nut 25. Finally, the sheath 45 is pushed up to the threaded nut 25, where it is bonded, or unless is forms a unit with the threaded nut 25.

Figure 7:
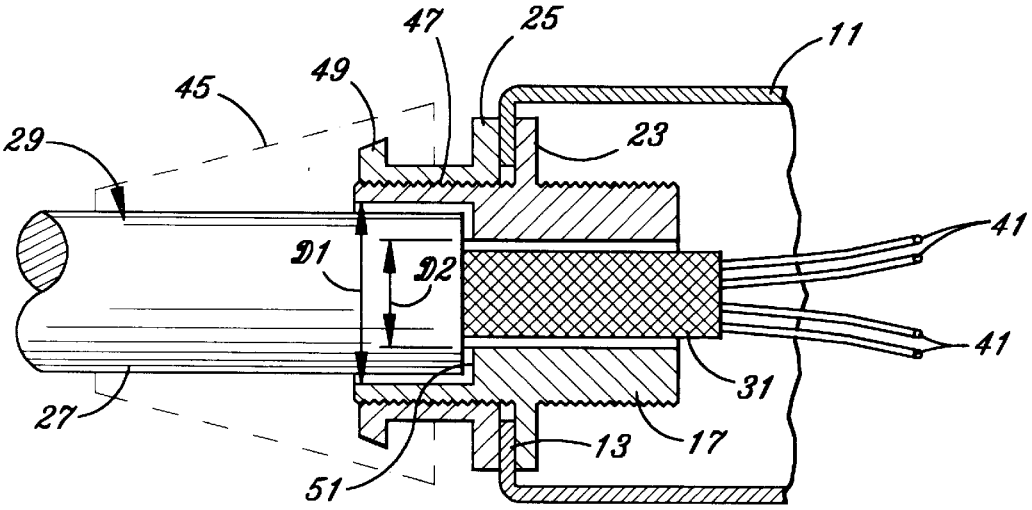
FIG. 7 is a modification of the connector arrangement shown in FIG. 1.

FIG. 7 shows a modification of the connector arrangement as compared to that shown in FIG. 1. In this embodiment, the sleeve 17 has a graduated inner diameter. A diametrical stage 51 is arranged between a larger inner diameter D1 at the cable inlet end of the sleeve 17 and a smaller diameter D2 extending over the remaining axial length of the sleeve 17. The larger diameter D1 is adapted to the outer diameter of the cable 29 so that it can accommodate an end area of the outer insulating jacket 27 of the cable 29. The smaller inner diameter D2 is adapted to the outer diameter of the shield 31 so that the free area of the shield 31 can extend throughout the sleeve area of smaller diameter D2. The end of the shield 31 may flush with the inner end of the sleeve 17 which is located inside the housing 11 or as shown in FIG. 7 protrude over the inner end of the sleeve 17.

The benefit of using a sleeve 17 of such a graduated diameter is that the transition from the outer insulating jacket 27 to the free shield 31 is protected within the sleeve. There is no gap between the sleeve 17 and the outer insulating jacket 27.

The threaded nut 25 is modified in the connector arrangement shown in FIG. 7. It is provided with a sleeve-shaped appendix 47 at the side at which the cable is inserted. A radial anchor 49, either in the form of a radial flange arranged around the appendix 47 or in the shape of several radially projecting teeth or barbs, extends from the free end of said appendix. It is advantageous, but not obligatory, to provide the entire threaded nut 25, including its sleeve-shaped appendix 47, with an external thread.

This embodiment of a connector arrangement may incorporate a preshaped sheath 45 the inner section of which is adapted to the sleeve-shaped appendix 47 and the anchor 49 and which is slipped over the anchor 49 and the sleeve-shaped appendix 47 after the threaded nut has been tightened. For this purpose, the side of the anchor facing away from the housing 11 may be provided with an inclined surface in order to facilitate the slipping over of the sheath 45, which consists of a flexible plastic material.

It is, however, particularly advantageous to form the sheath 45 by injection molding a plastic material around a part of the sleeve appendix 47 comprising the anchor 49 after tightening the threaded nut 25 and around an axial area of the cable 29 adjacent to the sleeve-shaped appendix. Preferably, the plastic material used for this process is the same as that used for the outer insulating jacket 27 of the cable 29. The end of the sheath 45 facing the housing 11 is preferably arranged at an axial distance from the part of the threaded nut 25 which is in contact with the housing 11.

The cable 29 is relieved of additional strain by the sheath 45 in that the outer insulating jacket 27 is now connected with the metallic housing 11 and the shield 31 does not have to bear the main load. Under load, the force is better distributed, whereby the soldered or crimped connection between the sleeve 17 and the shield 31 is relieved of strain. This results in a sturdier connection and affords better protection against damage from vibration because the nut cannot come loose when exposed to vibrations, as it is held stationary by the injection molded sheath 45. Furthermore, the protection against bending is improved. The injection-molded sheath 45 may be detached by an oblique cut between the head of the threaded nut 25 and the anchor 49 up to the corner of the right angle between the anchor 49 and the sleeve-shaped appendix 47 so that the protection sheath 45 can simply be torn off. This allows for on-site repairs. Upon completion of the repair, a shrink-down plastic tubing may be applied over the outer insulating jacket 27 and the housing 11.

I claim:

1. A metallic connector housing for a shielded electrical connector for connection to a tube-like electrical shield of an electrical cable having an outer diameter and being connected to the connector, the metallic connector housing comprising: a housing having an opening formed in a facing wall at a side where the electrical cable is inserted therethrough; an electrically conducting sleeve, having a through opening through which said electrical cable is inserted, said sleeve being provided with a flange contacting one side of the facing wall, the sleeve having at least one projection with an outer thread protruding from the other side of the facing wall, onto which a threaded nut is screwed in order to clamp the facing wall between the flange and the threaded nut, wherein an end area of the sleeve adjacent to the side at which the cable is inserted has an inner diameter adapted to the outer diameter of the cable, and wherein a part of the electrical shield which projects from the end area of the sleeve, and which faces the housing, is folded back over a sleeve appendix projecting from the flange into the housing to form a folded back part, said part of the electrical shield being electrically attached to the sleeve appendix by an attachment means squeezed onto the folded back part of the shield.

2. The metallic connector housing of claim 1, wherein the attachment means comprises a crimp sleeve.

* * * * *